United States Patent [19]

Crosby et al.

[11] 4,069,967

[45] Jan. 24, 1978

[54] CENTRIFUGE WITH CHATTER SUPPRESSION

[75] Inventors: Herbert L. Crosby, Plainville; Jacob P. Den Hartog, Concord, both of Mass.

[73] Assignee: Bird Machine Company, Inc., South Walpole, Mass.

[21] Appl. No.: 732,316

[22] Filed: Oct. 14, 1976

[51] Int. Cl.[2] ..... B04B 1/20

[52] U.S. Cl. ..... 233/1 C; 233/7

[58] Field of Search ..... 233/1 R, 1 C, 7, 23 R, 233/23 A; 68/23.1; 64/1 V, 2 R, 2 P, 27 B, 27 L, 28 R, 15 B, 15 C

[56] References Cited

U.S. PATENT DOCUMENTS

| | | | |
|---|---|---|---|
| 399,122 | 3/1889 | Adams et al. | 233/1 C |
| 2,288,425 | 6/1942 | Simborg | 64/28 R |
| 3,282,069 | 11/1966 | Wermlinger | 64/27 L |
| 3,685,722 | 8/1972 | Nichols | 233/23 R |

*Primary Examiner*—George H. Krizmanich
*Attorney, Agent, or Firm*—Edgar H. Kent

[57] ABSTRACT

Chatter is suppressed in a solids-liquid separating centrifuge by including, in an external connection to a holder of the speed change gearing between the centrifuge bowl and conveyor, a spring and mass means which is torsionally resilient about the axis of the connection such that it will vibrate about that axis under chatter conditions at the chatter frequency, and which has a spring rate within +40% to −25% of the spring rate at which the spring and mass means will vibrate in resonance with the vibration during chatter of the bowl-gearing-conveyor assembly.

11 Claims, 10 Drawing Figures

FIG 3
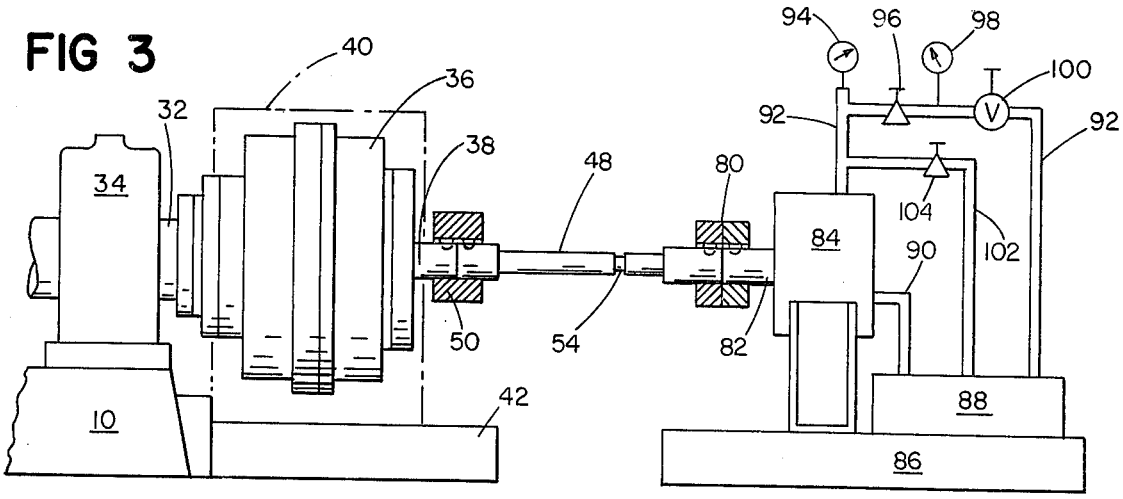
FIG 9
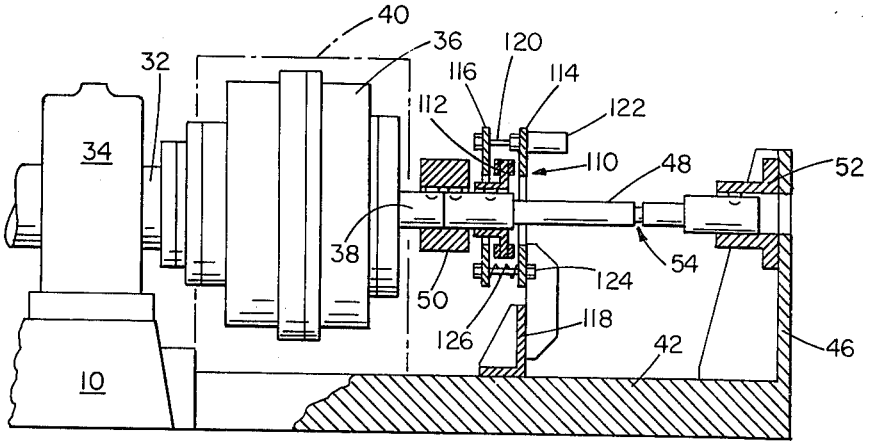
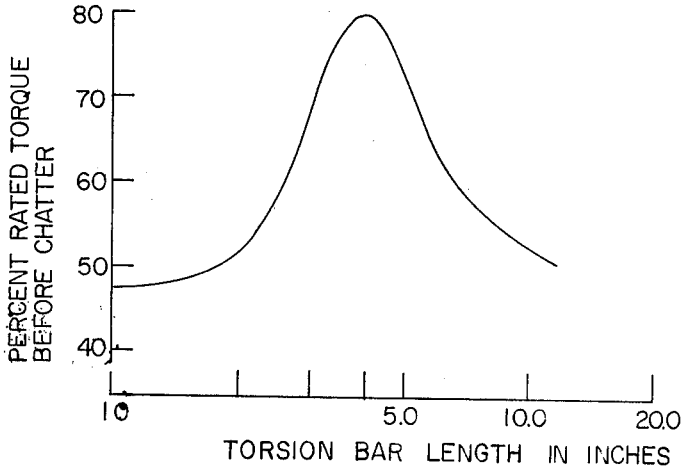
FIG 8

RATIO OF ANGULAR DISPLACEMENT OF
3/8 INCH DIAMETER STEEL TORSION BAR
TO THAT OF CONVEYOR AT VARIOUS BAR LENGTHS

| TORSION BAR LENGTH IN INCHES | SPRING RATE LB INCHES / RADIAN |
|---|---|
| 1 | 22,521 |
| 2 | 11,260 |
| 3 | 7,507 |
| 4 | 5,630 |
| 5 | 4,504 |
| 6 | 3,753 |
| 7 | 3,217 |
| 8 | 2,815 |
| 9 | 2,502 |
| 10 | 2,252 |
| 11 | 2,047 |
| 12 | 1,817 |
| 13 | 1,732 |
| 14 | 1,609 |
| 15 | 1,501 |

| TORSION BAR LENGTH IN INCHES | SPRING RATE LB INCHES / RADIAN |
|---|---|
| 16 | 1,408 |
| 17 | 1,325 |
| 18 | 1,251 |
| 19 | 1,185 |
| 20 | 1,126 |
| 25 | 900.8 |
| 30 | 750.7 |
| 35 | 643.5 |
| 40 | 563.0 |

CONVERSION TABLE: TORSION BAR LENGTH VS SPRING RATE
3/8 INCH DIAMETER STEEL TORSION BAR

RELATION OF PHASE ANGLE OF VIBRATION OF CONVEYOR TO THAT OF 3/8" DIAMETER STEEL TORSION BAR AT VARIOUS LENGTHS.

CHATTER FREQUENCY AT VARIOUS LENGTHS OF 3/8 INCH DIAMETER STEEL TORSION BAR

CENTRIFUGE WITH CHATTER SUPPRESSION

BACKGROUND OF THE INVENTION

1. Field of the Invention

This invention relates to solids-liquid separating centrifuges of the continuous type in which a bowl, imperforate or perforate, and a conveyor are rotated about a common axis in the same direction but at a differential speed. More particularly, the invention concerns the provision of such centrifuges with means for suppressing therein excessive torsional vibration called "chatter". 2. Description of the Prior Art Centrifuges of the type concerned utilize speed change gearing connected between the bowl and the conveyor so that rotation of one of them by a motor causes the rotation of the other at the differential speed. The conveyor may be rotated faster or slower than the bowl but is normally rotated slower. Either the bowl or the conveyor may be directly driven by the motor, but usually it is the bowl.

Such centrifuges when operated on certain slurries such as starch or similar sticky materials develop the excessive torsional vibration of chatter at throughputs well below rated capacity. Chatter normally occurs at the natural torsional vibration frequency of the centrifuge, typically between 20 and 60 Hz, and is believed to be the result of stick-slip between conveyor and bowl when processing such materials. In the resultant torsional vibrations, the torque in the system fluctuates about the mean, typically from zero to a maximum which may approach or even exceed the maximum torque for which the machine is designed. Such great and rapid torque variations drastically shorten the fatigue life of centrifuge components subject to them, notably of the gears and of the fail-safe overload devices such as a shear pin or friction clutch. Breakage of one or the other soon occurs if chatter is allowed to persist, with consequent great expense in downtime and in replacement cost in the case of the gearing. Yet to avoid chatter, the user may have to operate at throughputs below 40% of rated capacity.

U.S. Pat. No. 3,685,722 discloses that chatter may be inhibited by introducing a resilient flexible connection of lower spring rate between rotating parts of the bowl, conveyor and gearing assembly. Chatter was so suppressed up to full rated capacity of the centrifuge by an elastomeric sleeve secured between the conveyor and its trunnion. However, location of a chatter suppressing device between rotating parts of the assembly imposes certain undersirable restrictions on the design and dimensions of the device and makes access thereto for adjustment or repair difficult.

The speed change gearing utilized in such centrifuges, such as single or multistage planetary, or "Cyclo" gearing, has, in addition to its high torque connections to the bowl and conveyor, a low torque connection to an external holder means, which may be fixed structure or rotating, such as pinion slip device or a back drive for adjustably changing the differential speed. In the commonly used multistage planetary gearing, this external connection is from the first stage pinion, and its low torque is the torque on the conveyor connection divided by the gear ratio. The external connection normally includes the above-mentioned fail-safe device to prevent torque overload on the machine.

Because of relatively low torque applied to it and its location external to the bowl-gearing-conveyor assembly, the external connection is an advantageous location for a chatter-suppressing device if such a device, effective in this location, can be provided. Attempts have been made before to suppress chatter by devices included in the external connection. These devices have typically been torsionally resilient elastomeric couplings, or metal springs, arranged to vibrate torsionally in response to torsional vibration of the external connection. Such devices have succeeded in suppressing chatter of the external connection to some degree, thus prolonging the life of the fail-safe device and reducing downtime due to chatter-induced failure thereof. However, so far as known, they have not been effective to suppress proportionally, or even to any significant extent, chatter of the bowl-gearing conveyor assembly, and gearing failures due to chatter have persisted at a high rate despite the utilization of such devices.

SUMMARY OF THE INVENTION

The object of this invention is to provide centrifuges of the type concerned with a torsional vibration suppression device acting on or in the external connection of the gearing to effectively suppress chatter of the bowl-gearing-conveyor rotary assembly.

It has been discovered that the object of the invention can be attained by such a device which is properly designed to more effectively utilize positive damping forces to oppose the chatter-inducing forces arising within the conveyor rotary assembly. In U.S. patent application filed simultaneously herewith, Ser. No. 732,315, filed Oct. 14, 1976, owned by the assignee of the present application, there is disclosed such a device in which a torsional spring and mass means in the external connection is combined with a separate damping means acting in parallel with the spring and mass means to positively suppress its torsional vibration. The spring and mass means has a lower torsional spring rate than any torque-carrying component part of the bowl-gearing-conveyor assembly, and is connected to transmit torque from the gearing to the holder means. The preferred spring and mass means disclosed in the above application has a spring rate at which it vibrates torsionally in resonance with the torsional vibration of the centrifuge under chatter conditions; i.e., at the same or nearly the same frequency.

The present invention is the discovery that such preferred spring and mass means, referred to herein as "tuned" to the chatter frequency, is, of itself, effective to suppress chatter without the addition of separate damping. Although not as effective as it is with the separate damping means, such tuned spring and mass means without added damping has been found to effectively suppress chatter up to 80% or more of rated torque capacity of the centrifuge, thereby greatly raising the feed rate attainable without chatter. By "effectively suppress" is meant to eliminate, or reduce to harmless proportions such as less than 10% fluctuation from the steady applied torque. It thereby becomes possible to suppress chatter adequately for many cases without the complexity and expense of added damping equipment.

Since the spring and mass means that have been utilized have had insignificant inherent damping, their above-indicated effectiveness must be due to an increase in the exertion of inherent positive damping forces present in the bowl-gearing-conveyor assembly, probably an increase in the damping effect of oil on gearing components to which the external connection is most closely connected. This increase of inherent damping within the rotary assembly itself is due to the effects of inresonance vibration, as is shown by the fact that the effectiveness falls rather sharply essentially to zero as resonance is departed from by increasing or reducing the spring rate, the effective spring rate for the spring and mass means being within the range of +40% to −25% of that which will result in resonant torsional vibration.

The spring of the spring and mass means may be of any suitable torsionally resilient form such, for example, as a torsion bar or coil spring or a leaf spring assembly. A preferred spring is a solid torsion bar of low inherent damping capacity, which may be made of metal, such as steel or titanium, and is included coaxially in the external connection. The spring rate of the spring may be made adjustable, as by varying the unclamped length of a torsion bar which is free to vibrate torsionally. The mass of the spring and mass means is the mass of the spring and of all other components of the external connection that vibrate torsionally with the spring.

While chatter occurs at substantially constant frequency in centrifuges of the same or comparable design, differences in design such as size, gear ratio or type of gearing, normally result in differences in the chatter frequency, and in various other factors affecting the design of the spring and mass means. Therefore, for best results, a spring and mass means should be designed for each design of centrifuge, which is tuned to that centrifuge design for torsional vibration in or nearly at resonance therewith.

In designing the spring and mass means, present procedure is to initially determine experimentally for each centrifuge size, gear type and ratio, a spring and mass combination which vibrates torsionally in resonance with the chatter torsional vibration of the centrifuge rotary assembly. A torsion bar spring is connected axially to the external connection of the centrifuge to vibrate therewith in such a manner that its spring rate is adjustable, for example, clamping the end fixed against vibration with a clamp movable longitudinally of the bar to change its effective spring length and hence its spring rate to various calculable values. The centrifuge is operated in chatter with a known chatter producing feed slurry, such as P.V.C. beads or starch, at various adjusted spring rates of the bar until the bar and rotating assembly vibrate in resonance. Various procedures are available for detecting in-resonance vibration as follows:

1. The ratios of the amplitude of vibration of the bar to that of the conveyor at the different spring rates are compared until the maximum ratio is found, since at resonance that ratio will be maximum. The amplitude of conveyor vibration may be shown by a torsiograph installed on the conveyor, a suitable torsiograph being available from General Motors Corporation, Warren, Michigan, designated "Velocity Torsiograph No. 44", which provides an electric output corresponding in frequency and amplitude to the torsional vibration of the conveyor which appears as a sine wave on an oscilloscope. The amplitude of vibration of the bar may be determined by a suitable device, which may be a fixed pen, marking on tape applied to a disc or drum mounted on the bar.

2. Passing through resonance, there is a large shift in phase angle between the conveyor vibration and that of the bar. The conveyor vibration motion is shown by the torsiograph and the bar vibration motion may be determined by strain gage torque sensors applied to the bar, with equipment for showing as a sine wave on an oscilloscope fluctuations in direct current applied to the gages. Such gages and equipment are currently in use for the detection of chatter.

3. At resonance, there is a distinct frequency shift of both the conveyor and bar vibration motion. This is shown by both the torsiograph and the strain gage devices, and may be detected with either. The frequencies are compared until the shift occurs.

Two or all procedures may be used to check results. The procedures may be repeated with torsion bars of different diameters of further check results.

The proper combination of spring and mass so determined can then be used as standard for all like centrifuges. However, other springs than the test torsion bar but having the "resonant" spring rate of the latter may be used provided the mass is not changed. Changes in the mass will affect the required spring rate of the spring, so that a compensating change in the spring may have to be made.

It is noted that in determining the effectiveness of a spring and mass means in suppressing chatter, it is important to measure chatter of the conveyor as described above and not merely of the external connection. This is because, as earlier noted, suppression of chatter in the external connection does not necessarily suppress chatter in the centrifuge rotating assembly. For example, it was found that a long torsion bar of low spring rate would suppress chatter in the external connection but not in the centrifuge rotating assembly.

BRIEF DESCRIPTION OF THE DRAWINGS

In the accompanying drawings:

FIG. 3 is a side elevation view, partially in vertical cross-section, showing the spring and mass means embodiment of FIG. 1 connected between the centrifuge gearing and an hydraulic backslip device illustrated somewhat diagrammatically;

FIG. 8 is a curve showing chatter suppression by a torsion bar as it was varied in length to bring the natural torsional vibration frequency of the bar and mass into and out of resonance with the torsional vibration of the centrifuge rotary assembly under chatter conditions; and FIG. 9 is a side elevation view, partially in vertical cross-section, showing a modification of the spring and mass means of FIG. 1.

DESCRIPTION OF THE PREFERRED EMBODIMENTS

Figure 1:
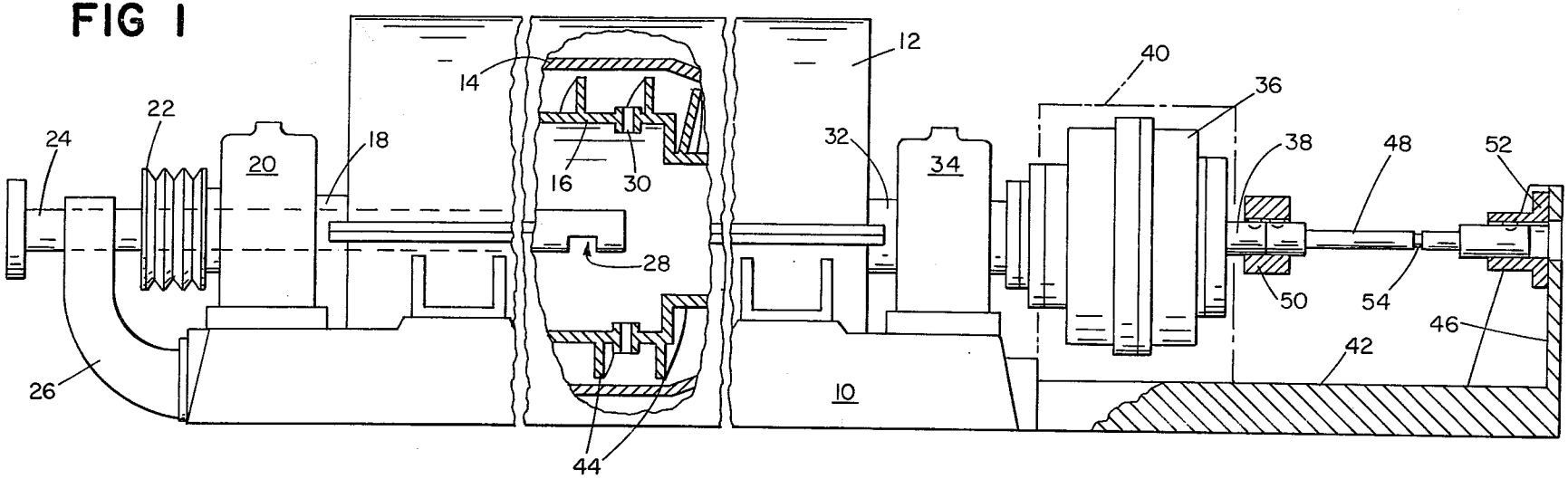
FIG. 1 is a side elevation view, broken away in part and partly in vertical cross-section, of a centrifuge of the type concerned equipped with chatter-suppressing spring and mass means according to the invention.

Referring to FIG. 1, the centrifuge there shown is of the solid bowl continuous type having a rotary assembly of bowl, planetary two-stage gearing and conveyor, of a standard design. A base 10 carries a casing 12 housing the bowl 14 and interior conveyor 16. A hollow drive shaft 18 rotatable in a support 20 on base 10 is connected at one end to the bowl and at the other end has a drive pulley 22 for sheave drive from a motor (not shown). A feed pipe 24, fixedly mounted in an arm 26 on base 10, extends through shaft 18, from an outer end connecting to a source (not shown) for supplying slurry thereto at a regulated rate, to an inner end inside the conveyor with a discharge outlet 28. Ports 30 in the conveyor hub discharge the feed slurry into the bowl. A hollow shaft (not shown) on one end of the conveyor is coaxially rotatably mounted in shaft 18.

A hollow shaft 32 on the bowl extends rotatably through a support 34 on base 10 and is connected to rotate the casing of speed change planetary gearing 36, of which the first stage pinion has a shaft 38 extending externally of the gearing casing and forming part of the external connection of the rotary assembly. A shaft (not shown) connected to the conveyor extends rotatably through shaft 32 and is connected to the second stage of gearing 36 so that it is driven thereby at a differential speed of rotation to that of the bowl, usually a lower speed. A housing 40 may be provided around the gearing, supported on an extension 42 of base 10.

Bowl 14 and one or more helical conveyor blades 44 on conveyor 16 have matching contours, cylindrical at one end and tapering, frusto-conical at the other, as indicated. The solids separating toward the bowl are moved by the conveyor from left to right in FIG. 1 to outlet ports (not shown) in the right-hand bowl end, from which they discharge to a chute (not shown) in casing 12. The clarified liquid flows from right to left in FIG. 1 to outlet ports (not shown) in the left-hand end of the bowl, and discharges to a receiving conduit (not shown) in casing 12.

In FIG. 1, the holder means for the external connection from the gearing 36 is a fixed support member 46 on base extension 42. The external connection includes first stage pinion shaft 38 and a spring and mass means in which the spring is a torsion bar 48 coaxially fixed at one end to shaft 38 by coupling clamp 50, and fixedly mounted at the other end in socket clamp 52 on holder member 46 fixed to base extension 42, the mass being that of bar 48, clamp 50, the pinion and its shaft 38 and possibly other gearing components. The clamps are of usual type, including keys engaging in slots in the bar as indicated. Torsion bar 48 may, as shown, be provided with a reduced diameter portion 54 of lowered shear strength which acts as the usual fail-safe shear pin on torque overload. Alternatively, a conventional shear pin may be clamped between bar 48 and shaft 38.

In accordance with the invention, torsion bar 48 has length and diameter dimensions which provide a spring rate such that the natural frequency of torsional vibration of the bar and mass is at or near resonance with the torsional vibration of the centrifuge rotating assembly under chatter conditions. The bar is preferably cylindrical and made of metal such as steel or titanium, although other material of adequate shear strength and resilience may be used, such as fiberglass.

Figure 2A:
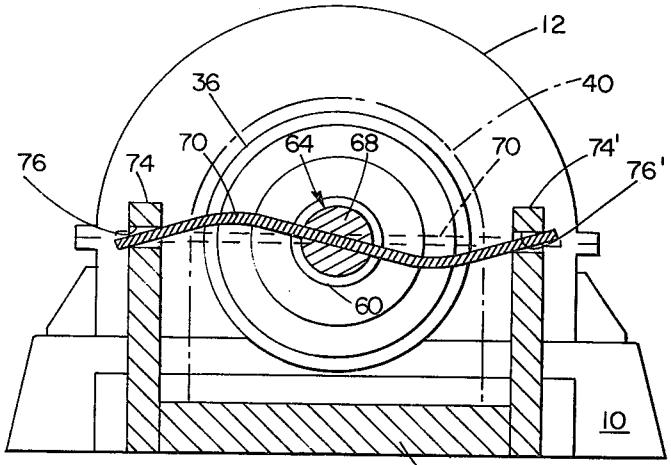
FIGS. 2 and 2*a* are respectively side and end elevation views, partially in vertical cross-section, of an end portion of the centrifuge of FIG. 1, showing another embodiment of spring and mass means.
Figure 2:
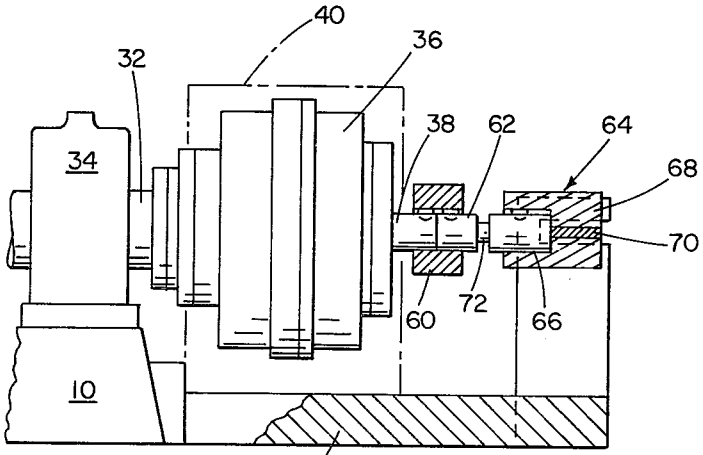

FIGS. 2 and 2*a* illustrate a modified embodiment of spring and mass means according to the invention. A clamp 60 secures to the end of shaft 38 one end of a short shaft 62 in axial alignment with shaft 38. Shaft 62 has at the outer end thereof a double clamp designated generally 64 formed at its inner end as a socket clamp 66 with keys to clamp onto the end of shaft 62, and at its outer end as a split flat clamp 68 the two jaws of which clamp the mid-portion of a flat leaf spring member 70. Member 70 is the spring of this embodiment of the spring and mass means, the mass being that of member 70, clamps 60 and 64, shafts 38 and 62 and the pinion. Clamp 64, like the other clamps previously mentioned, may be formed in two halves connected together by bolts (not shown) at opposite sides of the clamp axis. The shaft 62 may have, as indicated, a reduced diameter mid-portion 72 forming a shear pin.

A pair of fixed supports 74, 74' at either side of base extension 42 are provided with slots 76, 76' aligned with each other and with the axis of clamp 68, slots 76, 76' slidably receiving the opposite ends of spring member 70 and connecting the spring member to the holder formed by supports 74, 74'. When the centrifuge is idle, spring member 70 is straight, extending horizontally between slots 76, 76' as indicated by the dash line showing in FIG. 2*a*; whereas, with the centrifuge under torque load, spring member 70 bows at either side of clamp 68 toward the direction of torque load, clockwise in FIG. 2*a*, as shown in full lines in that Figure.

As in the case of torsion bar 48, spring member 70 has dimensions which provide a spring rate such that the natural frequency of vibration of the spring member and mass is at or near resonance with the torsional vibration of the centrifuge rotary assembly under chatter conditions.

An advantage of the embodiment of FIGS. 2 and 2*a* over that of FIG. 1 is that it may require, as indicated, less extension of the centrifuge in the axial direction. While a spring extended to only one side of the axis of clamp 68 could be used, this would exert undersirable bending forces on the remainder of the external connection.

A spring and mass means according to FIGS. 2 and 2*a* can be tuned to the desired natural torsional vibration frequency in manner similar to a torsion bar and mass as described earlier herein. Thus, supports 74, 74' may be made adjustable toward and away from one another so that the effective spring length of spring member 70 is shortened or lengthened, thereby raising or lowering its spring rate until a condition of resonance is attained.

The holder means for the external connection may be rotary, rather than fixed as in FIGS. 1, 2 and 2*a*. For example, FIG. 3 shows the outer end of torsion bar 48 in the external connection of FIG. 1 clamped by a clamp 80 in axial alignment to the pump shaft 82 of the rotary positive displacement hydraulic pump 84 of a pinion back slip device mounted on a base 86, pump shaft 82 and pump 84 being the holder means in this case. In conventional manner, the torque on the external connection drives pump 84 to pump hydraulic fluid from a sump 88 through line 90, the pump, a line 92, past a pressure indicator 94, through a pressure regulator 96, past a pressure indicator 98, through a flow control valve 100 back to sump 88. Regulator 96 passes a pre-set pressure irrespective of variation of torque applied to the pump, while valve 100 passes a predetermined fluid flow at that pressure. In this manner, the rate at which the pump can rotate is controlled by the amount of fluid flow allowed to pass valve 100. A bypass line 102 from line 92 to the sump, with relief valve 104, prevents excess pressure buildup by sudden torque increases.

If valve 100 is closed, bar 48 and pinion shaft 38 are held essentially fixed against rotation, as they are in FIG. 1. With valve 100 open, rotation of the bar, the shaft and the first stage pinion take place at a pre-set rate, changing accordingly the differential speed produced by the differential gearing 36.

The external connection may also be connected to a rotary back drive as the holder means. A back drive can be used to rotate the external connection in either direction. It uses an hydraulic motor and hydraulic pump in a drive and/or driven relationship depending on torque. Other types of back drives can be used. With a rotary holder for the external connection, the torsion bar form of spring means is used, the form shown in FIGS. 2 and 2*a* being unsuitable.

Figures 4, 5:
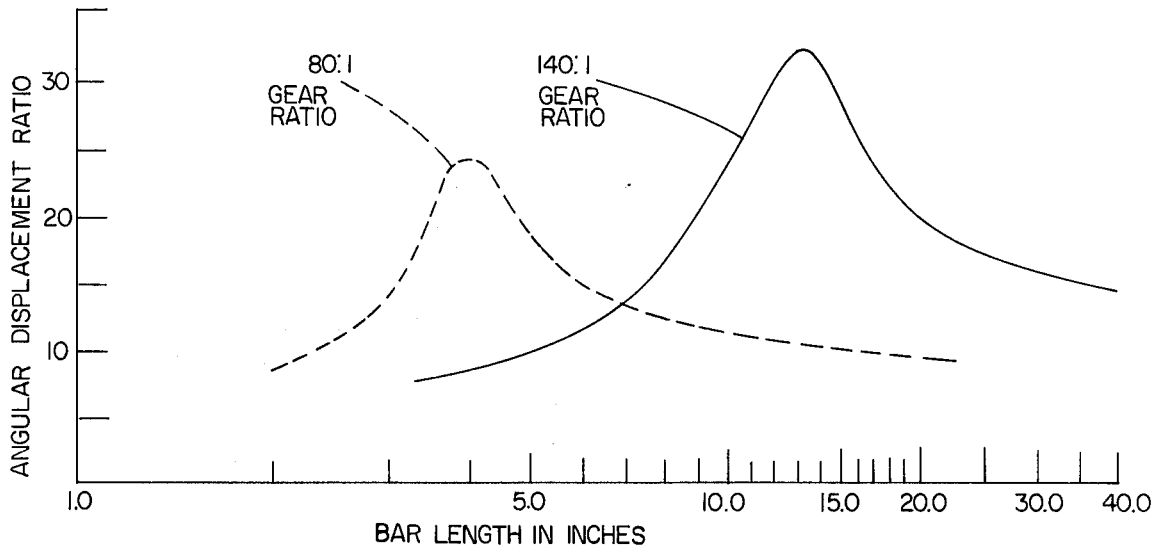
FIGS. 4, 6 and 7 are curves showing changes in certain ratios or values as a torsion bar was varied in length to bring the natural torsional vibration frequency of the bar and mass into and out of resonance with the chatter torsional vibration of the centrifuge rotary assembly.
FIG. 5 is a conversion table for converting lengths of the bar in FIGS. 4, 6 and 7 to corresponding spring rates.
Figure 6:
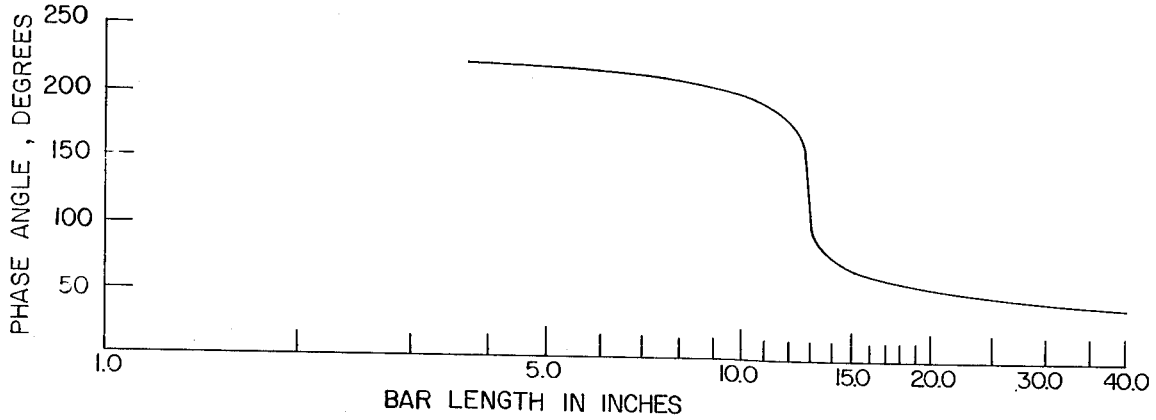
Figure 7:
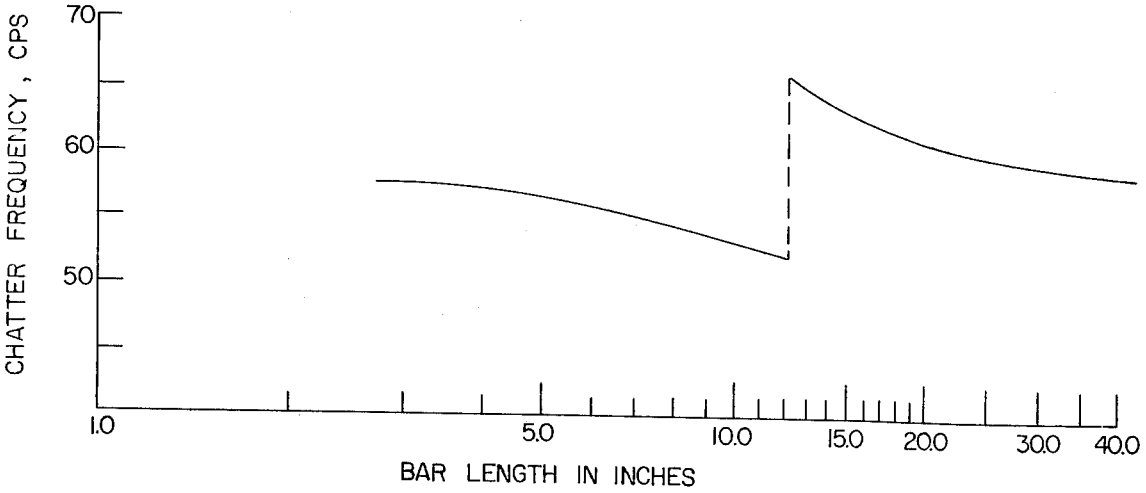

FIGS. 4, 6 and 7 are curves derived from plots of various values measured in arriving experimentally at spring and mass combinations having the desired torsional vibration in resonance with the chatter torsional vibration when incorporated in the external connection of a centrifuge of the type concerned of standard make with an 18 inch diameter by 28 inch long bowl. Torsion bar springs were used in deriving the data, connected as in FIG. 1 except that fixed support 46 and clamp 52 were replaced by a movble clamp and support assembly, so that the effective spring length of the bar between that clamp and the clamp 50 could be varied. For the curves shown, the torsion bar was of steel with a diameter of 0.375 inches, and the mass vibrating with the spring was maintained at a constant value. The conveyor was equipped with a torsiograph and strain gage sensors were applied to the external connection with outputs connected to oscilloscopes. The centrifuge was operated on a feed slurry of P.V.C. beads which caused it to chatter, normally at a feed rate of about 50% rated torque capacity. The bar lengths of FIGS. 4, 6 and 7 can be converted from the table of FIG. 5 to the corresponding spring rates in terms of pound inches of torque per radian of deflection.

In deriving the curves of FIG. 4, the ratios of the extend of angular movement in chatter of the pinion end of the bar to that of the conveyor at spring rates of the bar corresponding to various effective spring lengths thereof were plotted, with the ratios the ordinates, and the inch lengths the abscissae. The ratios were obtained for two interchangeable gear units of the same type but of different ratios:--an 80:1 ratio used for the dash line curve and a 140:1 ratio used for the full line curve. The angular movement values for the conveyor were obtained by measuring the amplitude peak to peak of the oscilloscope tracings of its vibration. Since the strain gage sensors do not directly measure amplitude of angular motion, such amplitude was obtained for the bar by measuring the length of markings of a fixed pen on tape applied to a disc or drum mounted on the bar.

It will be observed that the maximum ratio, indicating in-resonance vibration of the bar and rotary assembly, for the 80:1 ratio gear unit occurred at the bar spring rate at a four inch length of 5,630 pound inches per radian on the FIG. 5 table and for the 140:1 ratio gear unit occurred at the bar spring rate at a 13 inch length of 1,732 pound inches per radian on the FIG. 5 table. The curves rise and fall rather steeply over a relatively short range of effective spring lengths of the bar.

The curve of FIG. 6 shows the relation of the phase angle of vibration of the conveyor to that of the bar at various lengths of the bar in the tests used to establish the curve for the 140:1 gear unit in FIG. 4. The phase angles were compared from the oscilloscope tracings of the torsiograph and strain gage outputs, respectively. It will be noted that the phase angle shifted nearly 180° over the range of lengths tested, most of the change occurring at the bar length at resonance as shown by the full line curve of FIG. 4. The relationship shown by this curve can be used as an alternative indication of the desired resonant natural frequency of torsional vibration of the bar to the ratio of angular motion used for the FIG. 4 curves, or as a supplement thereto.

The curve of FIG. 7 was established from chatter frequency determinations at the various bar lengths in the tests establishing the 140:1 gear unit curve of FIG. 4 and the curve of FIG. 6. It will be seen that the chatter frequency dropped gradually about 5 cycles per second as the effective spring length of the bar was increased from minimum toward the length at which in-resonance vibration occurred as shown in FIGS. 4 and 6. At the in-resonance length, the chatter frequency increased abruptly more than 10 c.p.s., as indicated by the dash line, then declined slowly at longer lengths. This abrupt chatter frequency change can be used as another alternate or supplemental indication that the desired bar length has been attained. Since chatter frequency is shown by the strain gage output as well as by that of the torsiograph, this procedure has the advantage that it requires only one of these instruments.

As effective torsion bar length approaches the resonance length, it becomes necessary to increase the feed rate in order to cause chatter. This shows that at lengths corresponding to resonance or nearly so, the bar becomes effective as a chatter suppressing device. In fact, at the resonant length, chatter was effectively suppressed at feed rates up to 80% of rated torque capacity, as compared with full chatter encountered with bar lengths outside the vicinity of the resonance length at a feed rate of 50% of rated torque capacity.

FIG. 8 is a curve illustrating the chatter-suppressing effectiveness of a tuned torsion bar spring and mass means. The FIG. 8 curve shows the maximum feed rates, as percent of rated torque capacity of the centrifuge, before chatter occurred at various effective lengths of the torsion bar spring used with the 80:1 ratio gear unit to establish the left-hand dash line curve of FIG. 4 with the same centrifuge.

It will be seen that the maximum chatter suppression at feed rates up to 80% of rated torque capacity occurred at a bar length of 4 inches and corresponding spring rate of 5630 pound inches per radian, these being the length and spring rate at resonance as shown in FIGS. 4, 6 and 7. At considerably greater or lesser lengths and spring rates, the pre-chatter feed rate was only about 50% of rated torque capacity, and the bar was ineffective. Chatter was suppressed at feed rates above 70% at bar lengths between 3 and 5 inches, the corresponding spring rates whereof are within the range of +40% to −25% of the spring rate at resonance, which is regarded as the useful range for purposes of the invention.

Tests with torsion bar springs and different external masses vibrating therewith indicate that the effects at resonance are less pronounced with increased mass and therefore that the mass should be kept as low as consistent with design requirements.

FIG. 9 illustrates a modification of the spring and mass means of FIG. 1, the modification being the addition of separate damping means in accordance with the invention set forth in application Ser. No. 732,315 aforesaid. The parts shown that are the same as in FIG. 1 have the same reference numerals.

In FIG. 9, the added damping means, indicated generally by the reference numeral 110, comprises a friction disc 112, fixed to torsion bar 48 at its end adjacent shaft 38 and having friction facings on its opposite surface radial to the bar. A fixed damping member 114 and a movable damping member 116 are arranged to grip between them, on suitable adjustment of member 116, the friction facings on disc 112. Damping member 114 is fixed to bracket 118 secured to base extension 42. Damping member 116, movable axially of bar 48, is connected by rods 120 fastened by nuts thereon to the pistons of pull type pneumatic cylinders 122 (one shown), connected to a suitable source (not shown) of pneumatic or hydraulic pressure. Cylinders 122 alternate circumferentially of bar 48 with bolts 124 extending loosely through member 116 and fastened by nuts to member 114, rods 124 having surrounding coil springs 126. Adjustable damping is thus applied to bar 48 as it twists under torsional vibration by applying selected pressure to cylinders 122 to squeeze the friction surfaces of disc 112 between the damping members 114 and 116, against the action of springs 126.

The addition of damping means such as shown in FIG. 9 may be desirable, at least in some cases, to increase chatter suppressing effectiveness of the tuned spring and mass means alone. For example, the addition of such damping means, similar to that shown, to the bar used in the tests from which the curve of FIG. 8 was derived, at its in-resonance vibration length, increased chatter suppression from up to a feed rate corresponding to 80% of rated torque capacity, to up to a feed rate corresponding to more than 110% of rated capacity.

We claim:

1. In a solids-liquid separating centrifuge of the type which includes an assembly of a rotary bowl member, a rotary conveyor member mounted coaxially therein, and speed change gearing connected between said members so that rotationally driving one of them rotationally drives the other in the same direction at a differential speed, and a torquetransmitting external connection between said gearing and a holder means, the torque on said external connection being relatively low compared to the torque on the connections between said gearing and said bowl and conveyor;

the improvement for suppressing chatter of said assembly wherein:

said external connection comprises spring and mass means which is torsionally resilient about the axis of said external connection such that it will vibrate about said axis during chatter of said assembly at the same frequency; and the spring of said spring and mass means has a spring rate within the range of +40% to −25% of the spring rate at which said spring and mass means will vibrate in resonance with the vibration of said assembly during chatter.

2. A centrifuge according to claim 1 wherein said holder means is fixedly mounted.

3. A centrifuge according to claim 1 wherein said holder means is rotatably mounted.

4. A centrifuge according to claim 1 wherein said spring and mass means comprises a torsion bar coaxial with said connection.

5. A centrifuge according to claim 4 wherein said torsion bar has substantially no inherent damping.

6. A centrifuge according to claim 5 wherein said torsion bar is formed of metal.

7. A centrifuge according to claim 4 wherein said torsion bar includes a portion of reduced diameter and shear strength, said reduced shear strength being low enough to fracture in the event of predetermined torque overload of said assembly.

8. A centrifuge according to claim 2 wherein said spring and mass means comprises a spring member having its effective spring portion spaced radially outwardly from the axis of the gearing end of said external connection.

9. A centrifuge according to claim 8 wherein said spring member comprises a leaf spring connected centrally to the gearing end of said external connection and connected adjacent opposite ends thereof to said holder means.

10. A centrifuge according to claim 1 wherein said external connection comprises a pinion shaft of said gearing.

11. A centrifuge according to claim 1 wherein the spring of said spring and mass means has a spring rate such that said spring and mass means vibrates in resonance with the vibration of said assembly during chatter.

* * * * *

UNITED STATES PATENT AND TRADEMARK OFFICE

CERTIFICATE OF CORRECTION

PATENT NO. : 4,069,967

DATED : January 24, 1978

INVENTOR(S) : Herbert L. Crosby et al.

It is certified that error appears in the above-identified patent and that said Letters Patent are hereby corrected as shown below:

Col. 3, line 3, "inresonance" should be --in-resonance--;

Col. 4, line 14, "of" should be --to--;

Col. 9, line 10, "surface" should be --surfaces--;

Col. 9, line 47, "torquetransmitting" should be --torque-transmitting--.

Signed and Sealed this

Sixteenth Day of May 1978

[SEAL]

*Attest:*

RUTH C. MASON
*Attesting Officer*

LUTRELLE F. PARKER
*Acting Commissioner of Patents and Trademarks*